United States Patent [19]

Hoffmann

[11] 4,067,220

[45] Jan. 10, 1978

[54] ROLLING OF BILLETS

[75] Inventor: Rudolf Hoffmann, Krefeld, Germany

[73] Assignee: Maschinenfabrik Sack GmbH, Dusseldorf-Rath, Germany

[21] Appl. No.: 732,593

[22] Filed: Oct. 15, 1976

[30] Foreign Application Priority Data

Oct. 14, 1975 Germany ..... 2545935

[51] Int. Cl.[2] ..... B21B 45/02

[52] U.S. Cl. ..... 72/201; 72/202

[58] Field of Search ..... 72/199, 200, 201, 202, 72/342, 365, 366

[56] References Cited

U.S. PATENT DOCUMENTS

| | | | |
|---|---|---|---|
| 63,805 | 4/1867 | Miller | 72/200 |
| 3,347,076 | 10/1967 | Noda et al. | 72/201 |
| 3,403,541 | 10/1968 | Eisel | 72/201 |
| 3,479,852 | 11/1969 | Conrad et al. | 72/40 |
| 3,848,447 | 11/1974 | Strandell | 72/199 |

FOREIGN PATENT DOCUMENTS

| | | | |
|---|---|---|---|
| 32,049 | 9/1971 | Japan | 72/199 |

*Primary Examiner*—E. M. Combs
*Attorney, Agent, or Firm*—John J. Dennemeyer

[57] ABSTRACT

A method for rolling out a slab, preferably a slab produced by continuous casting, to form a billet having a square cross section, in which the width of the slab is reduced by repeated powerful edging passes, a temperature drop starting from the central region of the slab being provided during rolling, for example by spraying the edge regions of the slab with coolant, in order to give the edge regions greater deformation resistance and thus to prevent bulges at the edge regions. The bulge occurring in the central region of the slab is rolled away by guide rollers located at right-angles to the edging rolls. A rolling mill with suitable heating means is also provided.

5 Claims, 5 Drawing Figures

FIG.1
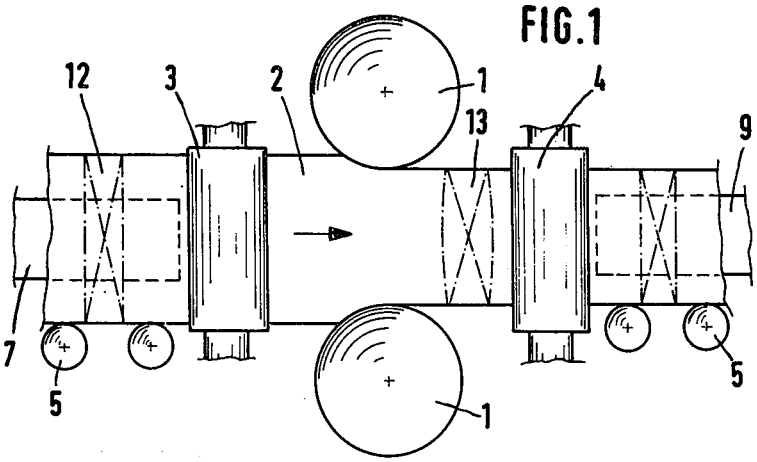
FIG.2
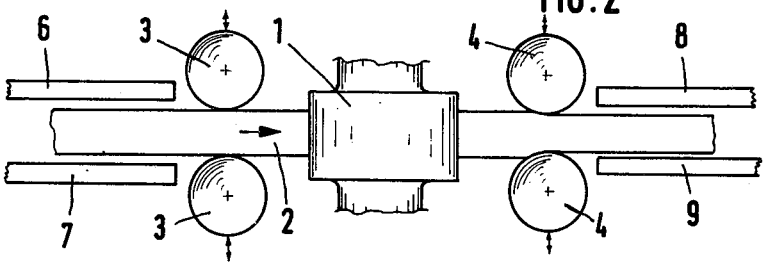
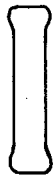
FIG.3
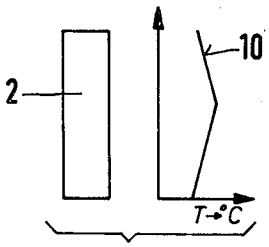
FIG.4
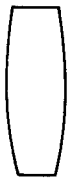
FIG.5

ROLLING OF BILLETS

The invention relates to a method and rolling mill for rolling out a slab, preferably a continuously cast slab, to form a billet having a square or approximately square cross section, in which the width of the slab is reduced with elongation by powerful repeated edging passes acting on its narrow sides and between the edging passes the slab is restored to a rectangular shape by a rolling operation on its broad sides. A known rolling method with these features, in which the actual shaping of the rolled stock is intended to take place solely by powerful edging passes, is intended to prevent local spreading, which leads to a so-called "dog's bone" configuration, due to a certain relationship between the diameter of the edging or working rolls and the width of the slab (German Offenlegungesschrift 2,254,676 corresponding to U.S. Pat. No. 3,848,447).

It was recognised that the undesirable "dog's bone" configuration with enlarged edge regions of the slab cannot be eliminated solely by a large diameter of the edging rolls, by which a large contact area is provided at the time of rolling, in order to allow the rolling pressure to act on the central region of the slab. In the case of relatively narrow slabs, a large diameter of the edging rolls may be successful in this respect, but not in the case of very wide slabs, such as are preferably used as continuously cast slabs.

It is therefore the object of the invention to ensure uniform compression of the rolled stock irrespective of the slab width. To solve this object, according to the method the invention consists in that a temperature drop starting from the central region of the slab is provided over the width of the slab. Since, in the range of the forging temperature, deformation resistance and temperature in practice behave in an inversely proportional manner, due to the invention, the deformation resistance decreases over the width of the slab from its narrow sides towards the centre with the result that at the colder and thus more resistant edge regions, the edging pressure of the edging or working rolls is less effective than in the central region of the slab with increased deformation resistance.

Under certain circumstances it is not sufficient to bring about the temperature drop, which is symmetrical with respect to the centre of the slab, only before the first edging pass, therefore it is appropriate to maintain the temperature drop during the rolling of a slab.

Since, with a decreasing slab width, the problem of undesirable spreading of the slab in its edge regions becomes increasingly less acute, it is advisable to reduce the temperature drop as the width of the slab decreases, if necessary to abolish the latter.

Two possibilities exist for producing the temperature drop, namely either spraying the edge regions of the slab or partial heating of the central region of the slab.

The known rolling method stipulates that the guide rollers located after a pair of edging rollers, which guide rollers are intended to restore the rectangular shape of the compressed profile by rolling, operate with a constant roll gap. Due to this, only the deformations produced by the preceding edging pass are equalized or smoothed out over the width of the slab. However, to obtain the temperature drop, it is important that even on passing through the guide rollers located at right-angles with respect to the edging rolls, the slab is preserved so far as possible, for which reason the rolling method according to the invention also provides that rolling takes place between the edging passes, with a reduction per pass of the thick material present at the edges of the slab. It is thus achieved, that the slab is also deformed over the entire width at right-angles to the upsetting effect of the edging rolls, due to which a heat loss in zones, which could modify the temperature drop provided, is prevented.

Based on the knowledge that a slab leaving a continuous casting installation automatically has the symmetrical temperature drop starting from the central region of the slab, according to a further proposal of the invention, the use of the method according to the invention with a slab which is still hot, leaving a continuous casting installation, is recommended, i.e. carrying out the method using the continuous casting heat.

Based on the known reversing rolling mill for carrying out the method, consisting of a pair of edging rolls (i.e., edge-working rolls) and two adjacent pairs of guide rollers (i.e., face-working rolls) machining the broad sides of a slab, the rolling mill according to the invention is characterised by devices for producing the temperature drop, located on both sides of the pair of edging rolls, which devices may consist of spray devices for cooling the edge regions of the slab or heating devices for heating or retaining the heat of the central region of the slab, thus establishing or maintaining a positive temperature gradient from the centerline of the slab outwardly to the edge regions. The guide rollers are appropriately provided with adjusting devices for varying the roll gap.

One embodiment of a reversing rolling mill according to the invention is illustrated in the drawings, by means of which the rolling method according to the invention is illustrated in detail:

FIG. 1 is a side view of the rolling mill shown diagrammatically for rolling a slab standing on its edge, FIG. 2 is a plan view of FIG. 1, FIG. 3 shows a so-called "dog's bone" configuration, FIG. 4 is a diagram illustrating the temperature drop or gradient and FIG. 5 shows a slab contour which has been correctly edged.

The reversing rolling mill illustrated comprises a pair of edging rolls 1 with a horizontal roll axis for rolling down a slab 2 placed on its edge, and pairs of adjustable guide rolls 3 and 4 (as shown by the arrows in FIG. 2) with horizontal roll axes, located on both sides of the pair of edging rolls. The slab 2 placed on its edge is supported by the rollers 5 of a roller bed.

It is important to prevent the "dog's bone" configuration illustrated in FIG. 3, with increases in thickness solely in the edge regions of a slab, by powerful edging passes, since when a profile of this type passes through a pair of guide rollers 3, 4, only the edge regions of the slab are stretched. In order to achieve uniform edging of the rectangular slab profile by the edging rolls 1, in order to achieve a profile according to FIG. 5, provided in the embodiment on both sides of the pair of edging rolls 1 and in particular outside the pair of guide rollers 3 and 4 on both sides of the slab 2 standing on its edge are inductive heating devices 6, 7 and 8, 9, which — as shown in dot-dash line in FIG. 1 — serve for the partial heating or retention of heat of the central region of the slab 2 (seen over the width of the latter). Due to these heating devices, a temperature drop which is symmetrical with respect to the central line of the slab 2, possibly along the line 10 in the diagram according to FIG. 4, is provided and substantially maintained during the entire rolling operation such that the central region of the slab is at a higher temperature and thus has a lower deformation resistance than at the edge regions of the slab. Conversely, the temperature drop or gradient could be maintained by spray devices (not shown) positioned adjacent the edge regions of the slab to cool said regions to a greater extent than the central region. The edge regions offer greater resistance to the edging pressure of the rolls 1, so that on the whole the edging pressure causes thickening of the slab in the central region, as shown in FIG. 5.

In the embodiment, the slab 2 travels through the rolling mill from left to right. The slab enters the gap between the guide rollers 3 with a rectangular cross section, as shown in dot-dash line at 12 in FIG. 1. In collaboration with the rollers 5 of the roller bed, the guide rolls 3 serve solely to guide the rolled stock and do not need to be set up for a reduction per pass. On passing through the edging rolls 1, a substantial reduction of the slab width takes place by one edging pass, which may naturally also be carried out with edging rolls arranged vertically. With a clear reduction of the slab width and with a correct adjustment of the temperature drop according to the invention according to FIG. 4, a correctly compressed profile is obtained as shown in dot-dash line in FIG. 1 at 13 in front of the guide rolls 4. The guide rolls 4 not only smooth the central bulges of the compressed slab profile, but as a result of the adjustability of the guide rolls 4, a reduction per pass preferably takes place over the broad sides of the slab 2, even if this is only a slight reduction, as shown in FIG. 2. Due to this, the material is deformed over the entire width, due to which temperature losses in zones are eliminated. During the reversing pass, the adjusting devices of the guide rollers 4 are preferably not actuated, whereas the guide rolls 3 and naturally also the working rolls 1 are adjusted.

The rolling process is continued until the slab 1 has been rolled down to form a billet of rectangular or approximately rectangular cross section, with considerable elongation. Continuous casting installations for billets may become superfluous due to the new rolling method, whereby rolled billets are obtained which from the metallurgical point of view are preferred to continuously cast billets, for further processing in small section rolling mills.

What is claimed is:

1. A method of rolling a slab to form a billet characterized as free from "dog's bone" defects, comprising the steps of:

a. introducing a slab of substantially uniform cross-section to a rolling apparatus comprising first and second sets of opposing face-working rolls and a set of opposing edge-working rolls disposed intermediately said sets of face-working rolls;

b. cycling said slab along a reciprocable path between said face-working and said edge-working rolls;

c. maintaining a positive temperature gradient from the center line of said slab outwardly thereof to effect greater deformation resistance to the edge regions than the central portion of said slab;

d. alternately applying deformation forces between said edge-working rolls and said first and second face-working rolls during said cycling step to:

i. effect longitudinal elongation of said slab; and, ii. alternately effect maximum material deformation of the slab in the central portion thereof to yield a bulged-shape cross-section due to application of deformation force between said edge-working rolls and to at least restore said slab to a substantially uniform cross-section by elimination of said bulged shape due to application of deformation force to the set of face-working rolls next adjacent said edge-working rolls in the direction of travel of said slab along said reciprocable path; thus precluding the formation of "dog's bone" defects in the cross-section.

2. The method of claim 1, wherein the step of alternately applying deformation forces further comprises applying a thickness reduction-effective force to the said set of faceworking rolls next adjacent said edge-working rolls.

3. The method of claim 1, wherein said step of maintaining said temperature gradient comprises directing a cooling spray of fluid to said edge regions.

4. The method of claim 1, wherein said step of maintaining said temperature gradient comprises heating the central portion of said slab.

5. Apparatus for rolling a slab to form a billet characterized as free from "dog's bone" defects, comprising:

a. means for introducing a slab of substantially uniform cross-section to a rolling apparatus comprising first and second sets of opposing face-working rolls and a set of opposing edge-working rolls disposed intermediately said sets of faceworking rolls;

b. means for cycling said slab along a reciprocable path between said face-working and said edge-working rolls;

c. means for alternately applying deformation forces between said plurality of edge rollers and said plurality of face rolles to effect longitudinal elongation of said slab, and alternately reduce the width thereof and form a bulged-shaped cross-section while deformation force is applied to said edge rollers, and at least restore said slab to a substantially rectangular cross-section while deformation force is applied to said face rollers; and, d. means for maintaining a positive temperature gradient from the centerline of said slab outwardly thereof to effect greater deformation resistance to the edge regions than the central portion thereof such that said means for alternately applying deformation forces achieves maximum material deformation in the central portion of said slab while force is applied to said edge rollers thus avoiding "dog's bone" defects in the cross-section of the slab during the rolling process.

* * * * *